US008326194B2

(12) United States Patent
Nakagaki et al.

(10) Patent No.: US 8,326,194 B2
(45) Date of Patent: Dec. 4, 2012

(54) BELT DRIVING APPARATUS HAVING BELT WITH DETECTION MARKS

(75) Inventors: Jun Nakagaki, Abiko (JP); Jiro Shirakata, Chigasaki (JP); Yoritsugu Maeda, Moriya (JP); Satoshi Atarashi, Toride (JP); Yukihiro Fujiwara, Toride (JP); Dai Kanai, Abiko (JP); Jun Nakazato, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 256 days.

(21) Appl. No.: 12/780,369

(22) Filed: May 14, 2010

(65) Prior Publication Data

US 2010/0303513 A1 Dec. 2, 2010

(30) Foreign Application Priority Data

May 26, 2009 (JP) ..... 2009-126320

(51) Int. Cl.
*G03G 15/01* (2006.01)

(52) U.S. Cl. ..... 399/301

(58) Field of Classification Search ..... 399/49, 399/299, 301, 302, 303, 312, 313
See application file for complete search history.

(56) References Cited

U.S. PATENT DOCUMENTS

| | | | |
|---|---|---|---|
| 7,076,195 | B2 | 7/2006 | Sakai |
| 7,343,127 | B2 | 3/2008 | Yamada et al. |
| 7,376,375 | B2 * | 5/2008 | Kobayashi et al. ..... 399/301 |

FOREIGN PATENT DOCUMENTS

| | | | |
|---|---|---|---|
| JP | 6-263281 | A | 9/1994 |
| JP | 11-024507 | A | 1/1999 |
| JP | 2004-170929 | A | 6/2004 |
| JP | 2006-139029 | A | 6/2006 |
| JP | 2006-139217 | A | 6/2006 |

* cited by examiner

*Primary Examiner* — Hoang Ngo
(74) *Attorney, Agent, or Firm* — Fitzpatrick, Cella, Harper & Scinto

(57) ABSTRACT

An image forming apparatus includes a rotatable belt member; a stretching roller for stretching the belt member; a plurality of line like marks which are arranged in a rotational direction of the belt member and are formed stepwisely on a surface of the belt member, the marks being tilted from a rotational axis direction of the belt member at least at end portions thereof on sides close to an end surface of the belt member; and control means for controlling rotation of the belt member on the basis of a result of detection of the marks.

5 Claims, 7 Drawing Sheets

BELT DRIVING APPARATUS HAVING BELT WITH DETECTION MARKS

FIELD OF THE INVENTION AND RELATED ART

The present invention relates to an image forming apparatus in which line-like marks arranged at an end portion of a belt member are optically detected to effect rotational speed control. Specifically, the present invention relates to an outer configuration of each of the line-like marks.

The image forming apparatus in which the belt member (an intermediary transfer belt or a recording material conveyer belt) is used to perform transfer of a toner image has been used widely. Such a belt member is stretched around a plurality of rotatable supporting members and is rotated in a tension state, thus being speed-controlled precisely.

With respect to the speed control of the belt member control such that a rotational speed of a rotatable supporting member is adjusted depending on an output of optical detection of line-like marks formed on the belt member, such has been put into practical use (Japanese Laid-Open Patent Application (JP-A) 2006-139217).

On an intermediary transfer belt shown in JP-A 2006-139217, many line-like marks perpendicular to a rotational direction of the intermediary transfer belt are arranged at regular intervals over a circumferential end portion of the intermediary transfer belt. In this case, the line-like marks are prepared by directly printing a line-like mark pattern on the surface of the intermediary transfer belt or by applying a thin tape, on which the line-like mark pattern has been printed, onto the entire circumferential surface of the intermediary transfer belt.

JP-A Hei 11-24507 discloses a method in which line-like marks are formed on a plastic sheet by a laser or the like and then are applied onto a belt member.

JP-A 2004-170929 discloses a method of directly printing scales on a belt member and a method of directly forming line-like marks on a belt member by laser machining.

JP-A 139029 discloses a method of forming line-like marks by forming on a belt member a layer in which a material which absorbs light of a predetermined wavelength such as titanium oxide fine particles or metal fine particles.

The intermediary transfer belt is formed in a thin film shape by using a high-rigidity resin material, thus being liable to cause peeling of a print pattern by nature. Further, when a diameter of the rotatable supporting member is decreased with a decreasing size of the image forming apparatus, repetitive stress acting on a print interface is increased, so that the print pattern is further liable to be peeled off.

In the case where the tape on which the line-like mark pattern is printed is applied, there is no worry that the print pattern is peeled off but pattern accuracy is lowered, compared with the case of directly forming the line-like mark pattern on the intermediary transfer belt, due to meandering error or the like during the application of the pattern. Compared with the case of the direct printing method, this application method entails superfluous material cost and assembly cost.

In view of this, as described in JP-A Hei 11-24507, the method of directly writing the laser machining on the intermediary transfer belt by using the laser machining has been proposed. By vaporizing a surface layer located inside contours of indicators so as to slightly roughen the surface layer by using the laser machining, the line-like marks different in refractive index from surrounding resin material surfaces can be formed.

However, when the intermediary transfer belt on which the line-like marks had been formed by using the laser machining was subjected to a continuous image formation, it turned out that a frequency of breakage of the intermediary transfer belt in a short period was increased compared with the intermediary transfer belt on which the line-like marks were not formed.

Further, when the broken intermediary transfer belt was observed, it was turned out that the breakage occurred from a corner of the contour, as a starting point, at an end portion of the line-like marks.

That is, the intermediary transfer belt was formed in the thin film shape by using the high-rigidity resin material and therefore it was turned out that the corner of the contour was capable of constituting the starting point of fatigue breakdown by the rotation even when the breakage by the laser machining was slight.

SUMMARY OF THE INVENTION

A principal object of the present invention is to provide an image forming apparatus capable of alleviating a degree of breakage from an end portion of processed line-like marks due to a tension of a belt.

According to an aspect of the present invention, there is provided an image forming apparatus comprising:

a rotatable belt member;

a stretching roller for stretching the belt member;

a plurality of line-like marks which are arranged in a rotational direction of the belt member and are formed stepwisely on a surface of the belt member;

the marks being tilted from a rotational axis direction of the belt member at least at end portions thereof on sides close to an end surface of the belt member; and control means for controlling rotation of the belt member on the basis of a result of detection of the marks.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, embodiments of the present invention will be described in detail with reference to the drawings. The present invention can be carried out also in other embodiments in which a part or all of constitutions of the respective embodiments are replaced by their alternative constitutions so long as an end portion of a line-like mark is tilted with respect to a direction perpendicular to a rotational direction of an intermediary transfer belt.

Therefore, the present invention is not limited to an image forming apparatus using the intermediary transfer belt but is also applicable to an image forming apparatus using a recording material conveyer belt. The present invention can be carried out in not only an image forming apparatus of a tandem type in which a plurality of photosensitive drums is disposed but also an image forming apparatus of one drum type in which a single photosensitive drum is disposed along a belt member.

In the following embodiments, only a principal portion concerning formation/transfer of the toner image will be described but the present invention can be carried out in various uses including printers, various printing machines, copying machines, facsimile machines, multi-function machines, and so on by adding necessary equipment, options, or casing structures.

<Image Forming Apparatus>

Figure 1:
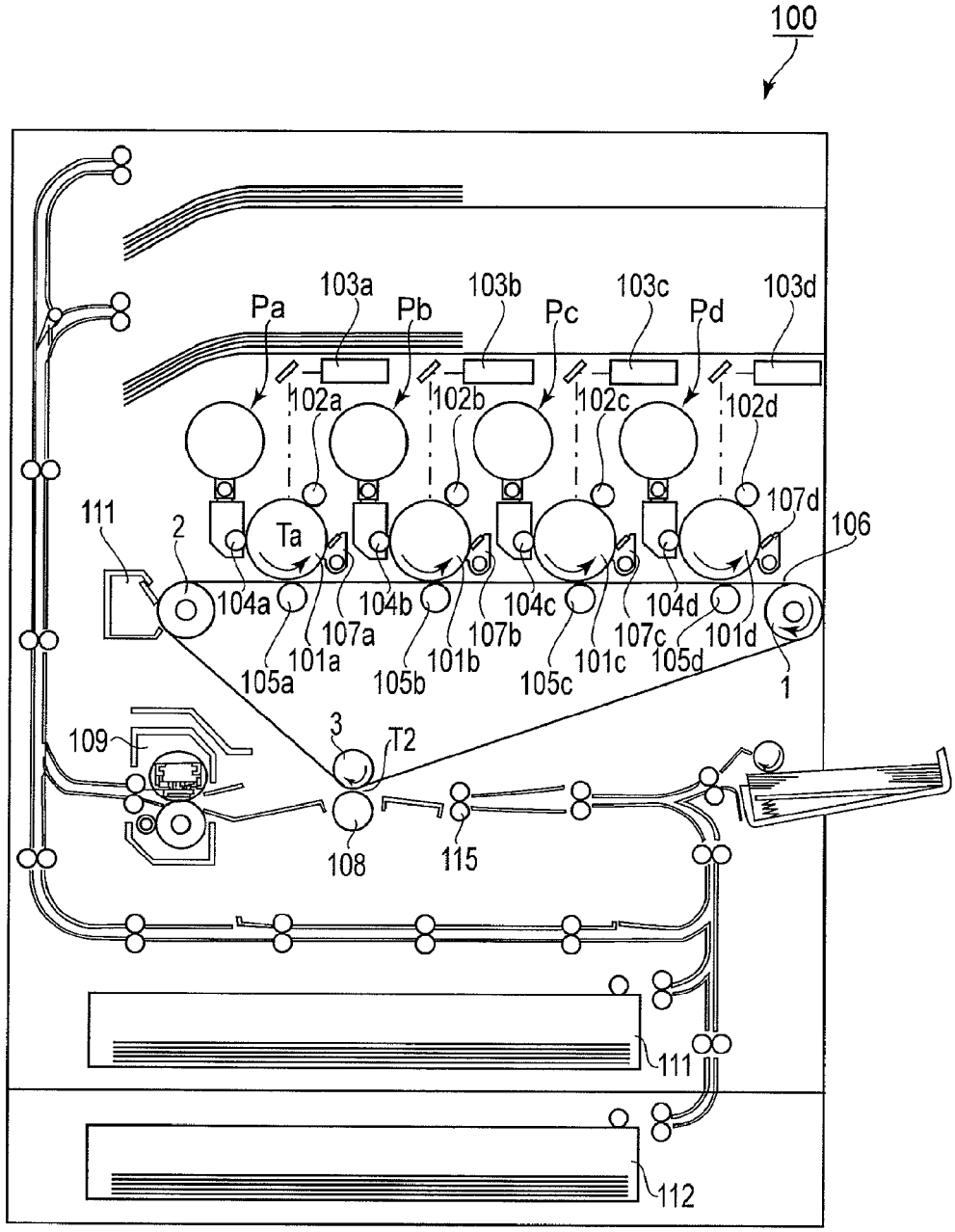
FIG. 1 is an illustration of a structure of an image forming apparatus.

FIG. 1 is an illustration of structure of an image forming apparatus.

As shown in FIG. 1, an image forming apparatus 100 in this embodiment is a tandem-type full-color printer in which image forming stations (portions) Pa, Pb, Pc and Pd different in development color are arranged along an intermediary transfer belt 106.

In the image forming station Pa, a yellow toner image is formed on a photosensitive drum 101*a* and then is primary-transferred onto the intermediary transfer belt 106. In the image forming station Pb, a magenta toner image is formed on a photosensitive drum 101*b* and is primary-transferred superposedly onto the yellow toner image on the intermediary transfer belt 106. In the image forming stations Pc and Pd, a cyan toner image and a black toner image are formed on photosensitive drums 101*c* and 101*d*, respectively, and are successively primary-transferred superposedly onto the magenta toner image on the intermediary transfer belt 106 similarly as in the case of the image forming station Pb.

The four color toner images carried on the intermediary transfer belt 106 are collectively secondary-transferred onto a recording material P at a second transfer portion T2 and thereafter are subjected to heat and pressure by a fixing device 109, so that the toner images are fixed on the surface of the recording material P.

The recording material P pulled out from cassette 111 (112) one by one awaits between registration rollers 115 and is sent toward the secondary transfer portion T2 while being timed to the toner images on the intermediary transfer belt 51.

The image forming stations Pa, Pb, Pc and Pd have the substantially same constitution except that the colors of toners of yellow, cyan, magenta and black used in developing devices provided in associated ones of the image forming stations are different from each other. In the following description, the image forming station Pa will be described and with respect to other image forming stations Pb, Pc and Pd, the suffix a of reference numerals (symbols) for representing constituent members (means) is to be read as b, c and d, respectively, for explanation of associated ones of the constituent members.

Figure 2:
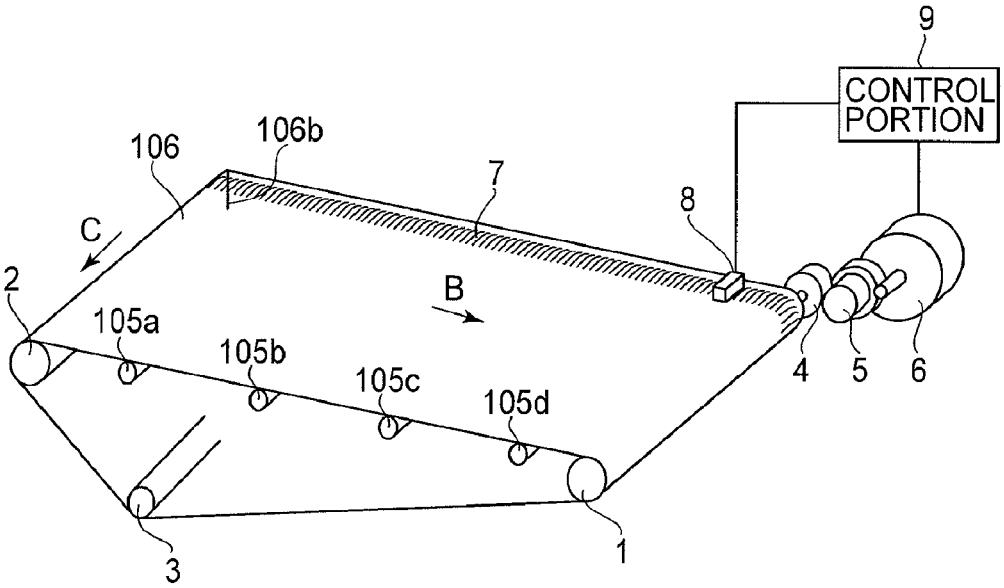
FIG. 2 is an illustration of control of a rotational speed of an intermediary transfer belt.

As shown in FIG. 2, the image forming station Pa includes the photosensitive drum 101*a*. Around the photosensitive drum 101*a*, a charging roller 102*a*, an exposure device 103*a*, the developing device 4*a*, a primary transfer roller 105*a*, and a drum cleaning device 107*a* are disposed in the image forming station Pa.

The photosensitive drum 101*a* is constituted by a metal cylinder on which a photosensitive layer having a negative charge polarity is formed at a surface of the metal cylinder and is rotated in a direction of an indicated arrow at a predetermined process speed.

To the charging roller 102*a*, an oscillating voltage in the form of a DC voltage based with an AC voltage is applied, so that the surface of the photosensitive drum 101*a* is electrically charged uniformly to a negative-polarity potential.

The exposure device 103*a* writes (forms) an electrostatic image for an image on the charged surface of the photosensitive drum 1*d* by scanning of the charged surface through a polygonal mirror with a laser beam obtained by ON/OFF modulation of scanning line image data expanded from image data.

The developing device 104*a* slides on the photosensitive drum 101*a* while carrying the negatively charged toner on a developing sleeve. To the developing sleeve, an oscillating voltage in the form of a negative-polarity DC voltage biased (superposed) with an AC voltage is applied, so that an electrostatic image is reversely developed on the photosensitive drum 101*a*.

The primary transfer roller 105*a* pressed the intermediary transfer belt 106 against the photosensitive drum 101*a*, thus forming a primary transfer portion Ta between the photosensitive drum 101*a* and the intermediary transfer belt 106. To the primary transfer roller 105*a*, a positive-polarity DC voltage is applied, so that the toner image negatively charged and carried on the photosensitive drum 101*a* is primary-transferred onto the intermediary transfer belt 106.

A second transfer roller 108 presses the intermediary transfer belt 106 against an opposite roller 3, thus forming the secondary transfer portion T2 between the intermediary transfer belt 106 and the secondary transfer roller 108. At the secondary transfer portion T2, the recording material P is nip-conveyed while being superposed on the toner images carried on the intermediary transfer belt 106 and the positive-polarity DC voltage is applied to the secondary transfer roller 108, so that the toner images are secondary-transferred from the intermediary transfer belt 106 onto the recording material P.

When the rotational speed of the intermediary transfer belt 106 is not kept at a constant level, a position in which the respective color toner images are to be transferred is deviated with respect to the rotational direction of the intermediary transfer belt 106, so that there arises a problem of color misregistration caused by superposition of the respective color toner images in a positional deviation state with respect to a sub-scan direction.

For example, even in the case where the rotational speed of the intermediary transfer belt 106 is somewhat lower than a normal speed, the toner image is formed on the photosensitive drum 101*b* with timing delayed by an estimated delay time from the timing for the photosensitive drum 101*a*. In this case, the speed of the intermediary transfer belt 106 is somewhat lower than the normal rotational speed and therefore the primary transfer of the toner image from the photosensitive drum 101*b* onto the intermediary transfer belt 106 is started before the toner image primary-transferred from the photosensitive drum 101*a* reaches the primary transfer position for the photosensitive drum 101*b*.

Therefore, on the intermediary transfer belt 106, the magenta toner image moves ahead of the yellow toner image in the rotational direction of the intermediary transfer belt 106, so that the color misregistration occurs with respect to the toner images secondary transferred and fixed on the recording material.

Here, in the case where the speed of the intermediary transfer belt 106 is constant and is not changed, when a delay time of exposure start for the photosensitive drum 101*a* and the photosensitive drum 101*b* is decreased in synchronism with the speed of the intermediary transfer belt 106, the color misregistration is eliminated.

However, actually, due to a fluctuation or the like of drive load on the intermediary transfer belt 106, the rotational speed of the intermediary transfer belt 106 can be higher than and lower than the normal speed, thus resulting in the occurrence of the color misregistration.

Further, similarly as in the case of the image forming apparatus using the intermediary transfer belt, also in the image forming apparatus in which the toner images are transferred from the plurality of the photosensitive drums onto the recording material by using the recording material conveyer belt, the color misregistration occurs for the same reason.

Therefore, in the image forming apparatus 100, a large number of line-like marks are formed on the surface of the belt member and are optically detected by a detecting means. By using feed-back of a detected pulse signal, drive control is effected by bringing the rotational speed of the intermediary transfer belt 106 near to a predetermined value to keep the rotational speed of the intermediary transfer belt 106 at a constant value.

<Intermediary Transfer Belt>

Figure 3:
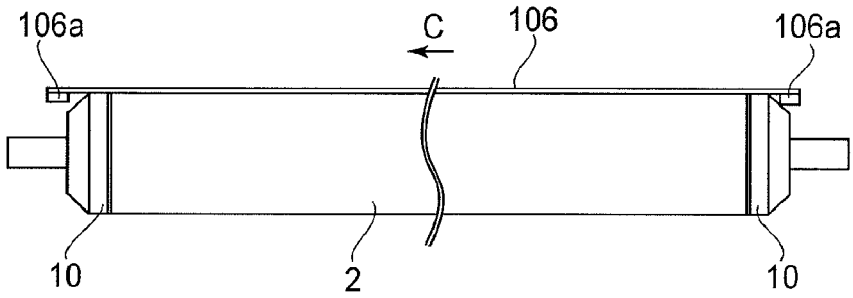
FIG. 3 is an illustration of a lateral deviation preventing structure for the intermediary transfer belt.
Figure 4:
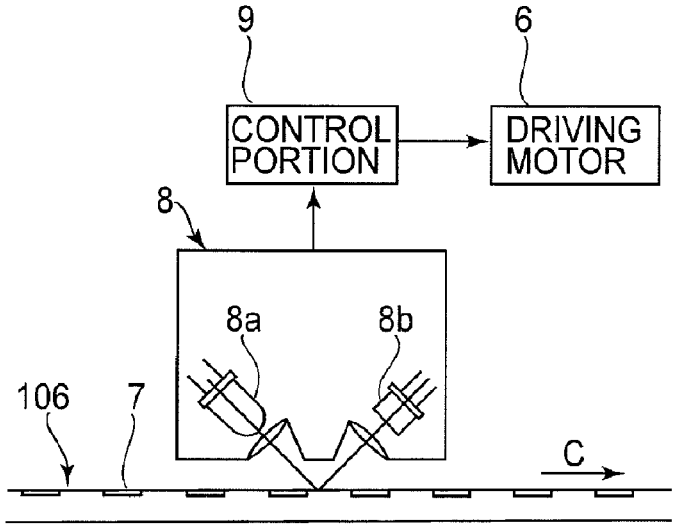
FIG. 4 is an illustration of detection of a line-like mark by an optical sensor.

FIG. 2 is an illustration of control of the rotational speed of the intermediary transfer belt. FIG. 3 is an illustration of a lateral deviation preventing structure of the intermediary transfer belt. FIG. 4 is an illustration of detection of the line-like mark by an optical sensor.

As shown in FIG. 2, the intermediary transfer belt 106 is stretched around and supported by a plurality of rotatable supporting members including a driving roller 1, a tension roller 2, and the opposite roller 3 in a tension state.

The tension roller 2 is urged outward by an unshown urging spring to apply a predetermined tension to the intermediary transfer belt 106.

To one end of a rotational shaft of the driving roller 1, a gear 4 is attached and is connected to a driving motor 6 through a gear train 5.

The intermediary transfer belt 106 is formed in an endless film shape by using a polyimide (PI) resin material so as to have a thickness of 80 μm, a peripheral length of 700 mm, and a width of 400 mm.

Incidentally, the intermediary transfer belt 106 may also be constituted by a thin endless belt member formed of a layer of a high-strength material such as a polyamideimide (PAI) resin material or formed by laminating on the layer of another material.

As shown in FIG. 3, at both longitudinal end portions of the tension roller 2, regulating collars 10 are attached rotatably with respect to the tension roller 2. Onto both end portions of an inner surface of the recording material 106 with respect to a widthwise direction of the belt member 106, lateral deviation preventing ribs 106*a* of urethane rubber are continuously applied over one full circumference.

When alignment among the driving roller 1, the tension roller 2, the opposite roller 3, and the like is broken, the intermediary transfer belt 106 is laterally deviated toward one side with respect to the widthwise direction thereof by its rotation. When the intermediary transfer belt 106 is laterally deviated toward one side, the intermediary transfer belt 106 is regulated with respect to the widthwise direction thereof so that the lateral deviation preventing rib 106*a* contacts the regulating collar 10 to prevent the intermediary transfer belt 106 from moving further.

As shown in FIG. 2, a scale 7 having markings (a large number of lines) is formed at uniform intervals over one full circumference of an end portion of the intermediary transfer belt 106 with respect to the widthwise direction of the intermediary transfer belt 106.

The scale 7 is made different in refractive index from a surrounding resin material surface by vaporizing a surface layer located inside individual contour in such a manner that the surface layer is roughened in a depth of about 2 μm so as to provide a different surface property by using the laser machining.

The laser machining is performed in a non-contact state so as to directly write the scale 7 as line segments extending in a direction perpendicular to the rotational direction of the intermediary transfer belt 106 on the material surface of the intermediary transfer belt 106 as a material to be machined, so that the scale 7 having a constant refractive index can be easily and inexpensively formed in a short time with accuracy.

As shown in FIG. 4 with reference to FIG. 2, an optical sensor 8 detects specular reflection light, of infrared light spot emitted from a light-emitting element (LED) 8*a* to the intermediary transfer belt 106, by a light-receiving element (phototransistor) 8*b*.

The intermediary transfer belt 106 is positionally deviated with respect to the widthwise direction thereof within a regulation range of the lateral deviation preventing rib 106*a* shown in FIG. 3. However, when the intermediary transfer belt 106 is located within the regulation range, the scale 7 possessing the different surface property for causing diffused reflection is formed so that the infrared light spot of the optical sensor 8 is not deviated from a parallel portion of the scale 7 (a range perpendicular to the rotational direction). Therefore, the optical sensor 8 always reads the parallel portion of the scale 7.

The optical sensor 8 outputs a signal correspondingly to a reflectance of the intermediary transfer belt 106 at an infrared light spot irradiation position. When the intermediary transfer belt 106 is rotated, the optical sensor 8 outputs an output signal, of a pulse train correspondingly to each of the markings of the scale 7, to a control portion 9. A time interval of individual pulse output by the optical sensor 8 corresponds to the rotational speed of the intermediary transfer belt at that time interval.

The control portion 9 feeds back the pulse train so that the pulse interval of the pulse train output by the optical sensor 8 is constant, thus controlling the drive of the driving motor.

Incidentally, as a method of forming the scale on the belt member, as described in JP-A Hei 11-24507, there is a method in which a scale sheet provided with a scale is applied onto the belt member. However, in this method, the scale sheet caused elongation, partial separation, meandering, and the like during the application, thus being problematic in terms of operativity and application accuracy. The scale sheet was a separate member with respect to the belt member, so that the material cost of the scale sheet was required, thus resulting in a problem of an increase in cost.

Further, as described in JP-A 2006-139029, there is also a method of forming the scale by directly printing the scale on the belt member. Although the scale formed by the printing provided a finishing state with high accuracy, the method was accompanied with a problem that the belt member was rubbed with the photosensitive drum and the cleaning blade during the use and thus the print pattern was gradually peeled and thinned.

In view of these problems, as described in JP-A 2004-170929, a method of forming line-like marks by arranging line segments of 5 mm to 10 mm in length with respect to the direction perpendicular to the rotational direction in parallel at an interval of 0.1 mm to 0.5 mm so as to provide a different surface property by the laser machining was proposed.

However, the intermediary transfer belt on which the scale is formed so as to provide the different surface property by the laser machining is placed in a state similar to that in which the belt member is scratched over one full circumference of the belt member with respect to the widthwise direction of the belt member. For this reason, with a cumulative operating time of the image forming apparatus, a frequency of breakage of the belt member from the end portion of the scale as a breakage stating point is somewhat higher than that of the intermediary transfer belt on which the scale is formed by the printing.

In view of this, in the image forming apparatus 100, by using the laser machining, the scale was formed so that the end portion of the scale on an edge side of the belt member was tilted toward an opposite side of the rotational direction with respect to the rotational direction of the belt member.

Embodiment 1

Figure 5:
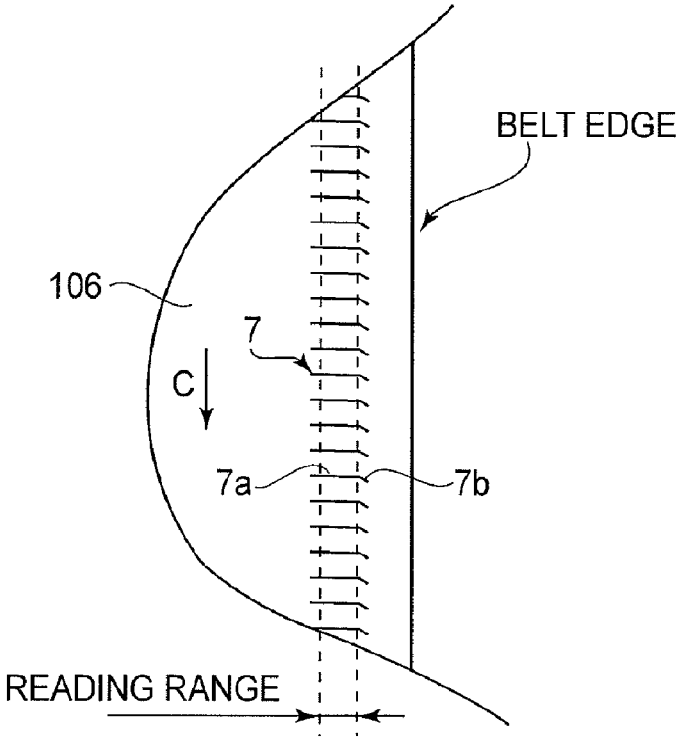
FIG. 5 is an illustration of a scale in Embodiment 1.
Figure 6:
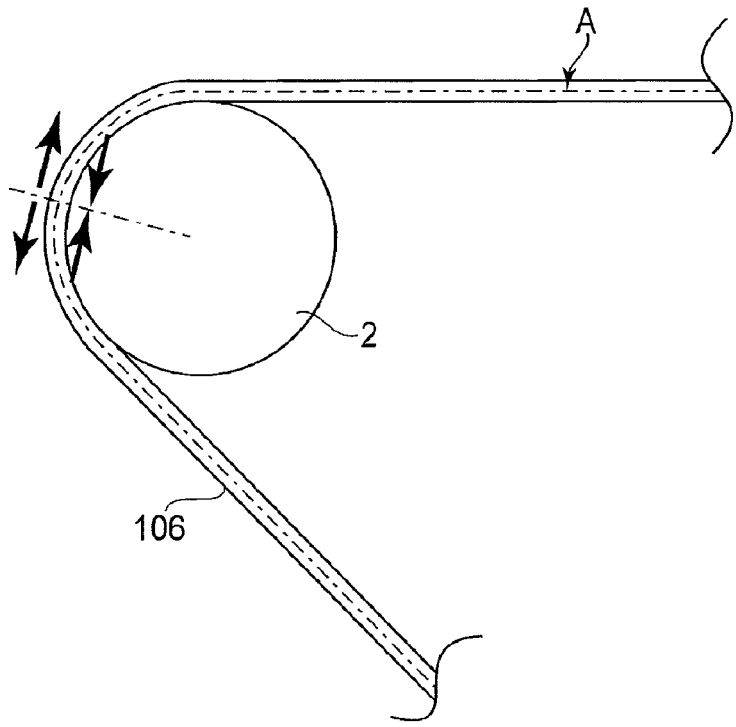
FIG. 6 is a schematic view showing a cross-section of the intermediary transfer belt in a state in which the intermediary transfer belt is wound (stretched) around a tension roller.
Figure 7:
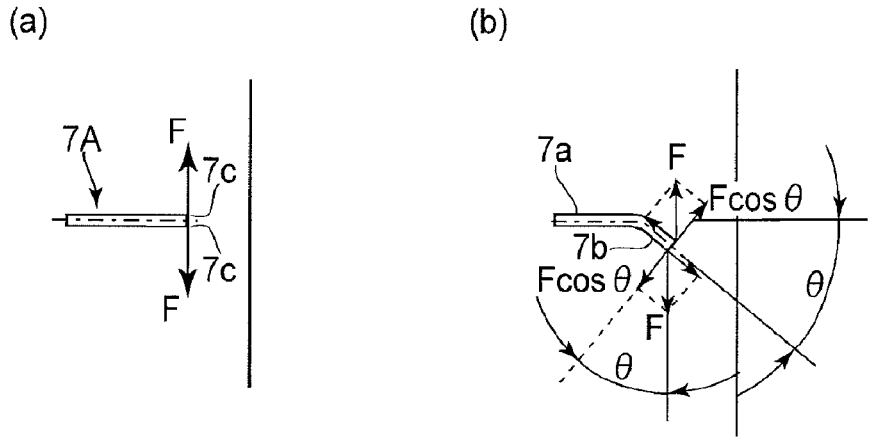
FIGS. 7(*a*) and 7(*b*) are enlarged views each showing a single line-like mark constituting the scale.

FIG. 5 is an illustration of a scale in Embodiment 1. FIG. 6 is a schematic view showing a cross-section of the intermediary transfer belt in a state in which the intermediary transfer belt is wound (stretched) around a tension roller. FIGS. 7(*a*) and 7(*b*) are enlarged views each showing a single line-like mark constituting the scale.

As shown in FIG. 5, the scale 7 in Embodiment 1 has a shape of an outer appearance such that each of the line-like marks is obliquely bent so that one end of a rectilinear line perpendicular to the intermediary transfer belt rotational direction is bent through a curved line. Specifically, a contour of each line-like mark is formed by smoothly connecting a non-parallel portion 7*b* obliquely tilted from the direction perpendicular to the intermediary transfer belt rotational direction to a parallel portion 7*a* perpendicular to the intermediary transfer belt rotational direction through an arcuate segment. That is, the scale 7 is consisting of the parallel portion 7*a* parallel to the widthwise direction of the belt member and the non-parallel portion 7*b* having an angle with respect to the widthwise direction of the belt member, and a connecting portion therebetween is consisting of the arcuate portion or the like which smoothly connects the parallel portion 7*a* and the non-parallel portion 7*b*.

The scale 7 in Embodiment 1 is, as a whole, formed as the rectilinear lines, each having a length of 5 mm with respect to the direction perpendicular to the intermediary transfer belt rotational direction and having a width of 10 μm, with 0.5 mm pitch so that the scale 7 is spaced from the edge of the intermediary transfer belt 106 by 1 mm. The tilting angle of the non-parallel portion 7*b* with respect to the parallel portion 7*a* is 37 degrees. The scale 7 is recessed by the laser machining with respect to its surrounding portion.

Generally, the scale 7 may preferably have the length of 1 mm to 10 mm, the width of 2 μm to 20 μm, the distance from the intermediary transfer belt edge of 1 mm to 10 mm, the pitch of 0.1 mm to 1.0 mm, and the angle of the non-parallel portion 7*b* with respect to the parallel portion 7*a* of 30 degrees to 45 degrees.

As shown in FIG. 6, the intermediary transfer belt 106 causes no change in length with respect to the rotational direction of a neutral surface (plane) A when it is wound about the tension roller 2 but an outside portion of the neutral surface A is elongated in the rotational direction and an inside portion of the neutral surface A is compressed in the rotational direction. The intermediary transfer belt 106 is a single layer formed of a single material, so that the neutral surface A is located in a depth of 1.2 (=40 μm) of the thickness of the intermediary transfer belt 106.

For this reason, when the intermediary transfer belt 106 is wound about the tension roller 2, a tensile stress is exerted on the outer peripheral surface of the intermediary transfer belt 106. The tensile stress is released when the intermediary transfer belt 106 is separated from the tension roller 2. A similar tensile stress is exerted on the driving roller 1 and the opposite roller 3 shown in FIG. 2, so that on the scale 7 formed on the surface of the intermediary transfer belt 106, the stress is repetitively exerted three times per rotation.

FIG. 7(*a*) shows a scale 7A having no non-parallel portion at its end portion and FIG. 7(*b*) shows the scale 7 provided with the non-parallel portion at its end portion in Embodiment 1.

As shown in FIG. 7(*a*), with respect to the scale 7A having no non-parallel portion, a load F is exerted on the end portion of the scale 7A as indicated by a double-pointed arrow. When the scale 7A is subjected to repetitive application of the load F, it is considered that fatigue breakdown occurs with corners 7*c* of the contour at the end portion of the scale 7A as a starting point. This is because an example in which cracks run toward the edge of the intermediary transfer belt 106 with the corners 7*c* as the starting point to cause the breakage of the intermediary transfer belt 106 has been reported.

As shown in FIG. 7(*b*), assuming that the angle between the parallel portion 7*a* and the non-parallel portion 7*b* is θ with respect to the scale 7 in Embodiment 1, the load F exerted on the end portion 7*b* of the scale 7 is divided into a component force exerted in a direction perpendicular to the end portion 7*b* and a component force exerted in a direction parallel to the end portion 7*b*.

A force for breaking the intermediary transfer belt 106 at the end portion 7*b* of the scale 7 is the component force exerted in the direction perpendicular to the end portion 7*b* of the scale 7, so that the magnitude thereof is F cos θ (<F). Therefore, when the non-parallel portion 7*b* is provided, the force for breaking the intermediary transfer belt 106 is decreased from F to F cos θ.

As shown in FIG. 2 with reference to FIG. 3, when the lateral deviation direction of the intermediary transfer belt 106 is indicated by an arrow C, the lateral deviation preventing rib 106*a* provided on the scale 7-side edge of the intermediary transfer belt 106 partly runs on the regulating collar 10 attached to the tension roller 2 to prevent the intermediary transfer belt 106 from moving outward.

At this time, a crease 106*b* obliquely crossing the markings of the scale 7 is formed so as to extend from the edge of the intermediary transfer belt 106 toward the inside of the intermediary transfer belt 106 with respect to the rotational direction toward the downstream side. The crease 106*b* similarly occurs also on the downstream side of the driving roller 1 and the downstream side of the opposite roller 3 by the lateral deviation prevention.

Then, when the scale 7 passes through the creases 106*b* formed in a normal state, the cross section of the intermediary transfer belt 106 is strongly bent by a small radius of curvature, so that strong tensile stress occurs at the end portion of the scale 7.

For this reason, in the case where the non-parallel portion 7*b* is tilted from the edge toward the inside with respect to the rotational direction toward the downstream side, when the non-parallel portion 7*b* passes through the creases 106*b*, the intermediary transfer belt 106 is bent with the non-parallel portion 7*b* as a bend line and thus stress concentration is liable to occur at the non-parallel portion 7*b*.

Therefore, in Embodiment 1, the non-parallel portion 7*b* is tilted from the inside toward the edge with respect to the rotational direction toward the downstream side, so that the stress concentration due to the bending of the intermediary transfer belt 106 with the non-parallel portion 7*b* as the bend line is obviated.

Further, with respect to the scale 7 in Embodiment 1, the end portion of the scale 7 is not released from the constraint by the tension roller 2 and the like simultaneously with the parallel portion 7*a* of the scale 7 during the rotation of the intermediary transfer belt 106. For this reason, the expansion and contraction at the parallel portion 7*a* of the scale 7 with respect to the rotational direction of the intermediary transfer belt 106 are less liable to influence the stress concentration of the intermediary transfer belt 106 at the end portion of the scale 7.

Further, on the edge side of the intermediary transfer belt 106, the non-parallel portion 7*b* of the scale 7 is tilted with respect to the rotational direction, so that the end portion of the scale 7 is not bent together with the parallel portion 7*a* at the same rotational position of the tension roller 2 and the like. For this reason, in a process in which the scale 7 passes through the tension roller 2 and the like, the stress concentration with the parallel portion 7*a* as the bend line is not caused to occur at the end of the non-parallel portion 7*b* of the intermediary transfer belt 106.

Therefore, a degree of the stress concentration at the end portion of the scale 7 during the rotation of the intermediary transfer belt 106 is alleviated, so that the fatigue breakdown of the intermediary transfer belt 106 with the end portion as the starting point is less liable to occur.

As described above, in Embodiment 1, the non-parallel portion 7*b* having the angle with respect to the widthwise direction of the belt member is provided on the edge side of the belt member where the scale 7 is formed. As a result, the scale 7 formed on the belt member by the laser machining which is a high-accuracy and inexpensive method is capable of preventing the breakage due to the stress caused by repetitive winding about the tension roller 2 and the like and release of the winding.

In Embodiment 1, the example in which the lateral deviation of the intermediary transfer belt 106 with respect to the intermediary transfer belt widthwise direction is prevented by the lateral deviation preventing rib 106*a* shown in FIG. 3 is described but steering control in which the tilting of the tension roller 2 is controlled to dynamically position the intermediary transfer belt 106 with respect to the intermediary transfer belt widthwise direction.

Modified Embodiment

Figure 8:
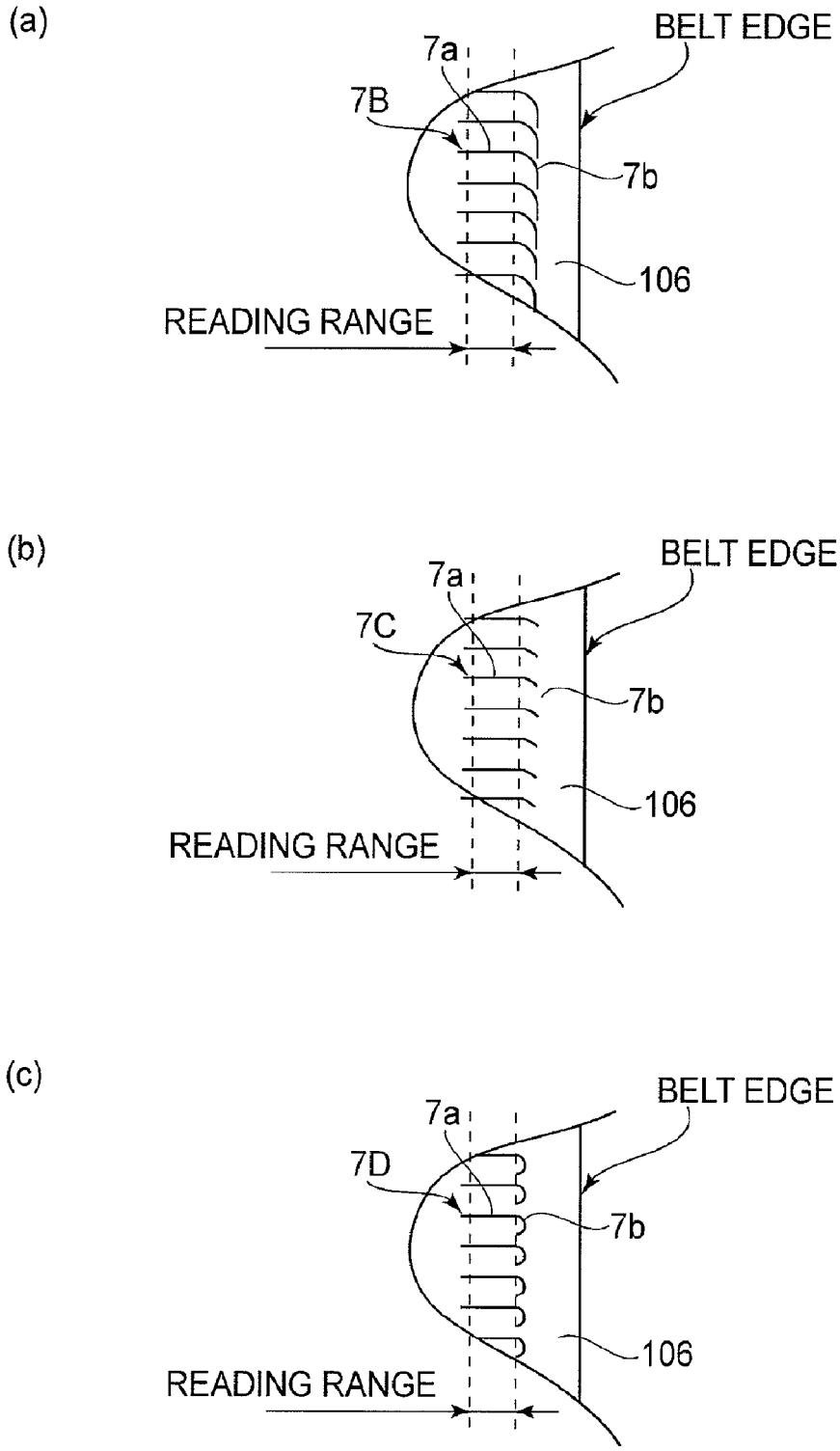
FIGS. 8(*a*), 8(*b*) and 8(*c*) are illustrations each showing a modified embodiment of the scale in Embodiment 1.

FIGS. 8(*a*) to 8(*c*) are illustrations each showing a modified embodiment of the scale 7 in Embodiment 1.

As shown in FIG. 5, in Embodiment 1, the scale 7 having such a shape that the parallel portion 7*a* parallel to the belt widthwise direction is smoothly connected with the non-parallel portion 7*b* obliquely tilted with respect to the belt widthwise direction is described.

Similarly as in the case of the scale 7 in Embodiment 1, compared with a comparative embodiment as shown in FIG. 7(*a*), the stress concentration at the end portion of the scale can also be alleviated with respect to scales 7B, 7C and 7D.

The scale 7B in the modified embodiment shown in FIG. 8(*a*) has a shape such that the parallel portion 7*a* parallel to the belt widthwise direction is smoothly connected with a non-parallel portion 7*b* tilted by 90 degrees with respect to the parallel portion 7*a*.

The scale 7C in the modified embodiment shown in FIG. 8(*b*) has a shape such that the parallel portion 7*a* parallel to the belt widthwise direction is smoothly connected with an arcuate non-parallel portion 7*b*.

The scale 7C in the modified embodiment shown in FIG. 8(*c*) has a shape such that the parallel portion 7*a* parallel to the belt widthwise direction is smoothly connected with a semicircular non-parallel portion 7*b*.

Embodiment 2

Figure 9:
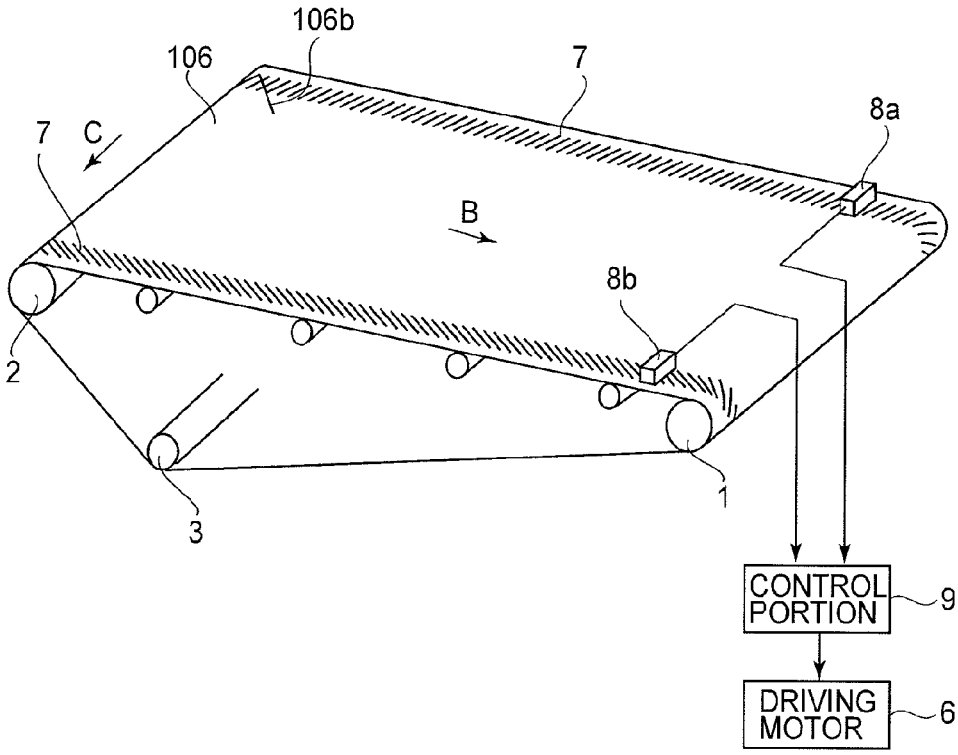
FIG. 9 is an illustration of control of a rotational speed of an intermediary transfer belt in Embodiment 2.
Figure 10:
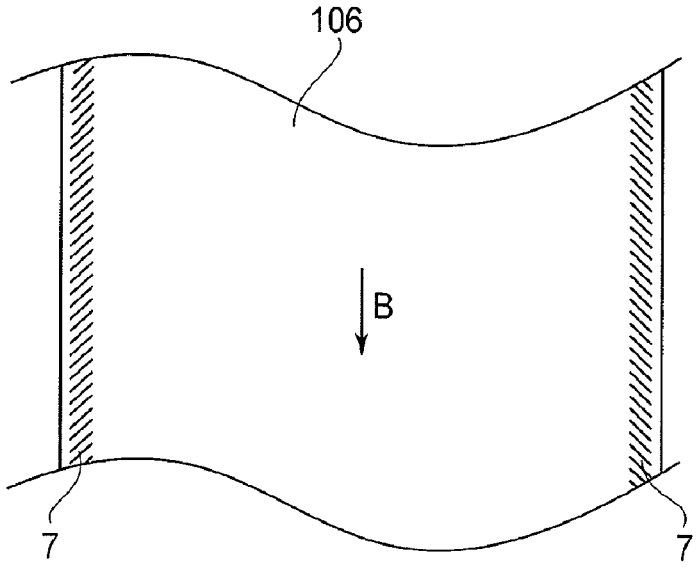
FIG. 10 is an illustration of a scale in Embodiment 2.
Figure 11:
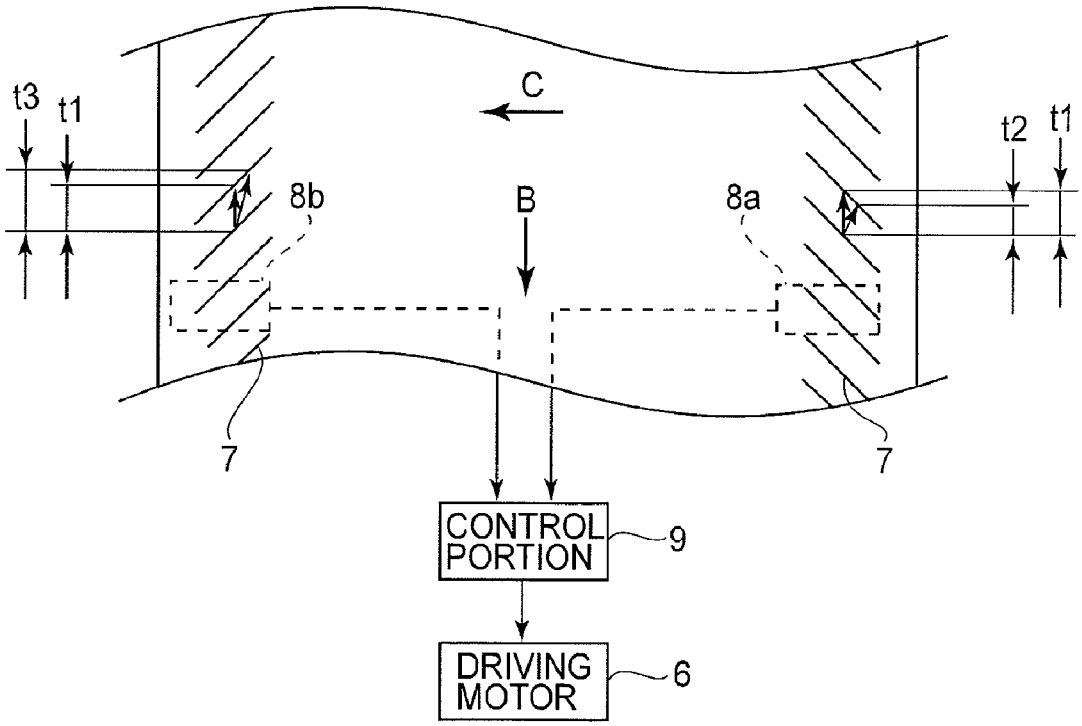
FIG. 11 is an illustration of a tilting direction of the scale in Embodiment 2.

FIG. 9 is an illustration of control of a rotational speed of an intermediary transfer belt in Embodiment 2. FIG. 10 is an illustration of a scale in Embodiment 2. FIG. 11 is an illustration of a tilting direction of the scale in Embodiment 2.

As shown in FIG. 9, the scale 7 in Embodiment 2 has an outer shape such that all the respective line-like marks are rectilinear and arranged so as to be tilted with the same tilting angle at both end portions of the belt member. That is, the scale 7 is formed at the both end portions of the intermediary transfer belt 106 so as to be tilted obliquely from the direction perpendicular to the belt rotational direction as a whole.

In the neighborhood of both edges of the intermediary transfer belt 106, a pair of scales 7 is provided by the laser machining and a pair of optical sensors 8*a* and 8*b* is provided correspondingly to the scales 7. The line-like marks are optically detected by the detecting means (8*a*, 8*b*), and a rotational speed of the intermediary transfer belt 106 is brought near to a predetermined value by using feed-back of a detected pulse signal so as to be kept at a constant value.

As shown in FIG. 10, the pair of scales 8 provided at the both end portions of the intermediary transfer belt 106 includes two types of line-like marks which are tilted at the same tilting angle in opposite directions, with respect to the direction perpendicular to the rotational direction of the intermediary transfer belt 106 (i.e., the widthwise direction of the intermediary transfer belt 106). In other words, the pair of scales 7 is formed bilaterally symmetrically.

As described with reference to FIG. 3, when the lateral deviation direction of the intermediary transfer belt 106 is indicated by the arrow C, as shown in FIG. 9, the crease 106*b* occurs on the downstream side of the tension roller 2 with respect to the rotational direction of the indicated arrow C of the intermediary transfer belt 106.

As shown in FIG. 10, in Embodiment 2, the scale 7 is formed by the laser machining and the intermediary transfer belt 106 is rotated in a direction indicated by the arrow B.

The scale 7 is formed so that the line-like marks are tilted from the rotational direction upstream side and the belt inner portion side toward the rotational direction downstream side and the belt end portion side at the constant angle of 40 degrees so that they are arranged in parallel to each other at the same interval.

By arranging the scale 7 in such a direction, even in the case where the intermediary transfer belt 106 is laterally deviated toward one side to cause the occurrence of the crease 106*b* as shown in FIG. 9, the scale 7 is not parallel to the crease 106*b*, so that the scale 7 runs over the crease 106*b* with an angle close to the right angle.

When the crease 106*b* occurs on the intermediary transfer belt 106, similarly as in the case described with reference to FIG. 7(*a*), the repetitive tensile stress is exerted in the direction perpendicular to the crease 106*b*. For this reason, by arranging the scale 7 in the direction as in this embodiment, the scale 7 is substantially parallel to the direction in which the tensile stress is exerted, so that the load exerted in a direction in which the intermediary transfer belt 106 is broken is less liable to occur. For this reason, the fatigue breakdown of the intermediary transfer belt 106 is not in process, so that it becomes possible to prevent the breakage due to the fatigue break down.

As shown in FIG. 9, the scale 7 in this embodiment does not include the parallel portion (7*a* shown in FIG. 5) parallel to the widthwise direction of the intermediary transfer belt 106 as described in Embodiment 1.

Therefore, when the intermediary transfer belt 106 is moved in the widthwise direction of the intermediary transfer belt 106, the interval of the scale 7 read by the optical sensor 7*a* on one side is deviated.

As shown in FIG. 11, when the lateral movement (deviation) of the intermediary transfer belt 106 does not occur, the interval of the scale 7 is t1 (sec). However, when the intermediary transfer belt 106 is laterally deviated in the arrow C direction while being rotated in the arrow B direction, the interval read by the optical sensor 8*a* is t2 (sec) and the interval read by the optical sensor 8*b* is t3 (sec).

Therefore, the control portion 9 takes an average of the intervals t2 and t3 to eliminate the influence by the lateral movement of the intermediary transfer belt 106, thus obtaining the interval t1 equal to that in the case of no lateral movement.

The control portion 9 obtains an arithmetic mean of the pulse intervals detected by the pair of optical sensors 8*a* and 8*b* and effects feed-back control with respect to the driving motor 6 so that the arithmetic mean value is constant, thus keeping the rotational speed of the intermediary transfer belt 106 at a constant level.

As described above, according to the scales 7 in Embodiment 1 and Embodiment 2, the occurrence frequency of the fatigue breakdown of the intermediary transfer belt 106 is lower than that in the case of the comparative scale 7A shown in FIG. 7(*a*). As a result of the solving of the problem of the comparative scale 7A, it is possible to provide an image forming apparatus less causing problems of peeling of the scale, breakage of the belt member, and the like while inexpensively forming the scale by a simple machining method. In the image forming apparatus, by optically reading the scale, the rotational speed of the belt member is controlled at a constant value and thus the occurrence of the color misregistration and the like can be suppressed.

As described above, in the image forming apparatus of the present invention, the end portion of the line-like mark is tilted with respect to the belt rotational direction on the belt member edge side, so that the line-like mark end portion is not released from the constraint by the rotatable supporting member together with another portion of the line-like mark during the rotation of the belt member. For this reason, the expansion and contraction of another portion of the line-like mark is less liable to influence the stress of the belt member at the line-like mark end portion.

Further, on the edge side of the belt member, the line-like mark end portion is tilted with respect to the belt rotational direction, so that the line-like mark end portion is not bent together with another portion of the line-like mark at the same rotational position of the rotatable supporting member. For this reason, in a process in which the line-like mark passes through the rotatable supporting member, the stress concentration with the line-like mark end portion as the bend line is not caused to occur at least at the line-like mark end portion.

Therefore, a degree of the stress concentration at the end portion of the line-like mark during the rotation of the belt member is alleviated, so that the fatigue breakdown of the belt member with the end portion as the starting point is less liable to occur.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 126320/2009 filed May 26, 2009, which is hereby incorporated by reference.

What is claimed is:

1. A belt driving apparatus comprising:

a rotatable endless belt member;

a stretching roller for stretching said belt member;

a plurality of line like marks, which are arranged in a rotational direction of said belt member, each including a diagonal portion located on a side close to an edge side of said belt member, wherein each diagonal portion is angled from a direction perpendicular to the rotational direction of said belt member, and each mark is recessed from a surface of said belt member; and control means for controlling rotation of said belt member on the basis of a result of detection of said marks.

2. An apparatus according to claim 1, wherein each diagonal portion is angled downstream in the rotational direction of said belt member from an inside position of said belt member to the edge side of said belt member.

3. An apparatus according to claim 1, wherein each of said marks has an outer configuration such that the diagonal portion, which is of a diagonally bent curved shape, is connected to a rectilinear portion which extends in the direction perpendicular to the rotational direction of said belt member.

4. An apparatus according to claim 1, wherein said marks have a rectilinear outer configuration such that each of said marks is angled from the direction perpendicular to the rotational direction of said belt member as a whole, and said marks are provided at both lateral edge sides of said belt member so as to be symmetrical with respect to the rotational direction of said belt member.

5. An apparatus according to claim 1, wherein said belt member is formed of a resin material, and said marks are formed by laser machining so as to have a surface property different from that of neighboring surfaces.

* * * * *